United States Patent [19]

Koshizuka et al.

[11] Patent Number: 4,673,618

[45] Date of Patent: Jun. 16, 1987

[54] THERMAL RECORDING MEDIUM

[75] Inventors: Kunihiro Koshizuka; Takao Abe; Shigehiro Kitamura; Hiroshi Watanabe, all of Hino, Japan

[73] Assignee: Konishiroku Photo Industry Co., Ltd., Tokyo, Japan

[21] Appl. No.: 724,102

[22] Filed: Apr. 17, 1985

[30] Foreign Application Priority Data

Apr. 25, 1984 [JP] Japan ..... 59-81689
May 9, 1984 [JP] Japan ..... 59-91115

[51] Int. Cl.[4] ..... B41M 5/26

[52] U.S. Cl. ..... 428/336; 428/195; 428/207; 428/216; 428/500; 428/913; 428/914

[58] Field of Search ..... 428/195, 207, 484, 488.1, 428/488.4, 913, 914, 213, 215, 216, 336, 500

[56] References Cited

U.S. PATENT DOCUMENTS 4,265,978 5/1981 Morishita et al. ..... 428/913
4,271,224 6/1981 Mizuno et al. ..... 428/914

*Primary Examiner*—Bruce H. Hess

*Attorney, Agent, or Firm*—Frishauf, Holtz, Goodman & Woodward

[57] ABSTRACT

Disclosed is a thermal recording medium having a heat-transferable coloring agent layer, wherein said coloring agent layer contains a heat fusible substance which has at least one segment represented by the following formula [I]:

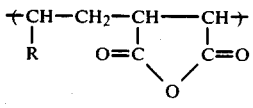

formula [I]

wherein R is a monovalent group or atom.

The thermal recording medium of the present invention provides a coated surface of a coloring agent layer which is homogeneous and smooth, thereby giving a dye transferred image on a recording sheet such as plain paper which is free from irregularity and also high in transfer efficiency and resolving power.

14 Claims, No Drawings

THERMAL RECORDING MEDIUM

BACKGROUND OF THE INVENTION

This invention relates to a thermal recording medium, particularly to a thermal recording medium which is capable of obtaining a homogeneous and smooth coated surface of a coloring agent layer and obtaining a dye transferred image without irregularity and with high resolving power on a recording sheet such as plain paper.

A thermal recording medium has been used as the recording medium for forming an image by transfer on a recording sheet such as plain paper by means of a thermal printer or thermal facscimile. Such a thermal recording medium has at least one heat-transferable coloring agent layer on a support. A layer containing a coloring agent comprising a dye such as pigment and a heat fusible substance has been known, for example, as the coloring agent layer. As the heat fusible substance, a low melting substance such as wax is used. As the support, in order to obtain good reproducibility of the dye transferred image obtained from the coloring agent layer coated thereon, a film excellent in surface smoothness and dimensional stability has been employed.

The thermal recording medium is produced by providing by coating a coloring agent layer by the hot melt method or the solvent method on such a support which is excellent in surface smoothness and dimensional stability. However, in the case of the coloring agent layer containing a heat fusible substance of the prior art, there is the problem that a coloring agent layer with a constant film thickness and smoothness can be obtained with difficulty. Thus, when the coated surface of the coloring agent layer is non uniform, during letter printing, particular in recording of solid images, irregularity will appear to disadvantageously deteriorate image quality, while the coloring agent layer containing the heat fusible substance of the prior art is poor in transfer efficiency.

SUMMARY OF THE INVENTION

The present invention has been accomplished in view of the state of the art as described above and its technical task is to obtain a coated surface of a coloring agent layer which is homogeneous and smooth, thereby obtaining a dye transferred image on a recording sheet such as plain paper which is free from irregularity and also high in transfer efficiency and resolving power.

The present inventors have continued extensive studies and consequently found that the above technical task can be solved by a thermal recording medium having a heat-transferable coloring agent layer on a support, wherein said coloring agent layer contains a heat fusible substance which has at least one segment represented by the following formula [I] (hereinafter referred to as the heat fusible substance of the present invention):

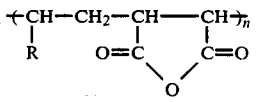

formula [I]

wherein R is a monovalent group (particularly organic group) or atom.

For example, R may include a hydrogen atom, a halogen atom, an alkyl group, a group containing an aromatic group (e.g. substituted or unsubstituted aryl group), an acyl group, an oxycarbonyl group of an alkyl or an aryl, a carbamoyl group (e.g. including substituted or unsubstituted alkylcarbamoyl groups), an alkoxy group, a sulfonyl group of an alkyl or an aryl, a sulfamoyl group, a hydroxy group, an amido group, an imido group, these groups optionally having substituent, or otherwise groups containing inorganic or metal atoms, but R is not limited to these groups. Preferably, R represents a hydrogen atom or an alkyl group. When R is an alkyl group, it may be either straight or branched, having carbon atoms not more than 100, more preferably not more than 50, further from 10 to 40.

DETAILED DESCRIPTION OF THE INVENTION

The thermal recording medium of the present invention has at least coloring agent layer on a support. In said coloring agent layer, at least one heat fusible substance of the present invention is contained.

The heat fusible substance of the present invention is described in detail by referring to a typical example, having a basic skeleton as shown below:

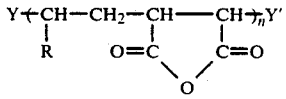

wherein R is a monovalent group including, for example, a hydrogen atom, a halogen atom, an alkyl group, a group containing an aromatic group (e.g. substituted or unsubstituted aryl group), an acyl group, an oxycarbonyl group of an alkyl or an aryl, a carbamoyl group (e.g. including substituted or unsubstituted alkylcarbamoyl groups), an alkoxy group, a sulfonyl group of an alkyl or an aryl, a sulfamoyl group, a hydroxy group, an amido group, an imido group, these groups optionally having substituent, or otherwise groups containing inorganic or metal atoms and may preferably be a hydrogen atom or an alkyl group having 19 to 40 carbon atoms, and n is preferably 2 to 30.

R is not necessarily the same carbon number, but it may have an appropriate distribution.

Also, the terminal portion Y or Y' is not particularly limited, and may be, for example, represented by a hydrogen atom. Particularly, R should preferably an alkyl group having 20 to 30 carbon atoms, with a molecular weight of 1000–10,000, particularly 2,000–8,000 being preferred. Commercially available products, such as Diacaruna 30 or Diacaruna PA30L (produced by Mitshbishi Kasei K.K.), can also be used.

The above compounds can be prepared by, for example, polymerization of $CHR{=}CH_2$ and a compound of the formula:

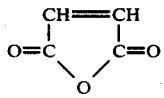

as the monomers. During this polymerization, in most cases, alternate copolymers are formed, but sometimes the same monomeric units may exist adjacent to each other to give a block or random copolymer. Depending on such structures, the monomeric ratio cannot necessarily be 1:1, but such a copolymer is also useful in the present invention. Further, a ternary copolymer containing another structural segment such as of acetylene or butadiene may also be used.

The heat fusible substance of the present invention can be obtained by copolymerization of maleic anhydride and an olefin, and unaltered substances may be mixed in the polymer depending on the synthetic method, but such unaltered substances should preferably be not more than 50%.

The heat fusible substance of the present invention should preferably have a penetration of not more than 10 at 25° C. (100 g), more preferably 8 or less, particularly 6 or less. Penetration is measured according to the JIS K 2530. It should preferably have a melting point (measured value by Yanagimoto's MPJ-2 Model) of 45° to 85° C., more preferably 50° to 75° C. Further, it should preferably have a melt viscosity at 100° C. of 1000 cp or less, particularly 500 cp or less. Also, its molecular weight may preferably be not more than 100,000, particularly 1000 to 10,000.

In the coloring agent layer of the present invention, other heat fusible substances than the heat fusible substance of the present invention may also be contained. Particularly, it is preferred to use a low molecular weight polyethylenical heat fusible substance, having preferably a number average molecular weight of 200 to 10,000, particularly preferably 300 to 6,000, and a melting point preferably of 40° to 140° C. (as measured by Yanagimoto's MPJ-2 Model), particularly preferably 50° to 80° C. Its melt viscosity at 100° C. should preferably be 200 cp or less, particularly 100 cp or less.

The polyethylenical heat fusible substance may be produced according to the high pressure method, the medium pressure method, the low pressure method or any other production method. It may be either low density type or high density type, but preferably is low density type. And, although it is possible to use a low molecular weight polyethylene obtained by purification of the product prepared by pyrolysis or other methods from a high molecular weight polyethylene, it is particularly preferred to employ a direct preparation method in which polymeriation is terminated at a low molecular weight. It is also preferred to use a polymer having at least one ethylene monomer unit. As the monomers copolymerizable with ethylene monomer, there may be included, for example, ethylenically unsaturated acids such as acrylic acid or methacrylic acid, alkylene oxides such as ethylene oxide or propylene oxide, phthalic acid and others. It is also possible to use those in which the side chain portion is a long chain or modified wholly or partially with polar groups (particularly acidic groups), or those converted to metal salts in the present invention. Specific examples may include low molecular weight polyethylene wax, polyethylene acrylic acid wax, polyethylene vinyl acetate wax, polyethylene propylene oxide wax, polyethylenephthalate wax, polyethylene ethylene oxide wax, etc. These may also be commercially available, as exemplified by Sunwax 131-P, 151-P, 161-P, 165-P, 171-P (all produced by Sanyo Kasei K.K.), PW-400, PW-500, PW-655, PW-850, PW-1000, PW-200 (all produced by BARECO Co.), WEISSEN 0252C, WEISSEN 0453 (all produced by Nippon Seiro K.K.), etc. Particularly, WEISSEN 0252C and are preferred.

Examples of other heat fusible substances may include (1) ester waxes (natural wax such as carnauba was, montan wax, etc., synthetic ester wax such as Hoechst WAX E, F, KP, KPS, BJ, OP, OM, X22, U and O, produced by Hoecst AG; (2) oxidized waxes (waxes obtained by oxidation of waxes such as paraffin wax, microcrystalline wax, etc., NPS-9210, NPS-6115, produced by Nippon Seiro K.K., PETRONABA C, CARDIS 314, produced by Toyo Petrolite K.K.); (3) hard waxes [waxes with penetration at 25° C. (100 g) less than 8]such as acid wax (e.g. Hoechst Wax S and LP produced by Hoechst AG). Also, soft waxes [waxes with penetration at 25° C. (100 g) of 8 or more], may also be used in combination with the heat fusible substances other than the heat fusible substance of the present invention, and typical examples thereof may include microwax [Nisseki Microwax 155, 180 (produced by Nippon Sekiyu K.K.), HI-MIC-1080, HI-MIC-2065, HI-MIC-2095, HI-MIC-1070, HI-MIC-2045 (produced by Nippon Seiro K.K.), STAR WAX 100, BE SQUARE 175, 185, VICTORY, ULTRAFLEX (produced by Toyo Petrolite K.K.), etc.], stearic acid, behenic acid, stearyl alcohol, white wax, beeswax, dodecyl stearate, stearone, sorbitane monostearate, polyoxyethylene monostearate, etc.

The coloring agent to be contained in the coloring agent layer of the present invention may be selected suitably from the dyes known in the art; for example, direct dyes, acidic dyes, basic dyes, disperse dyes, oil soluble dyes, and pigments such as carbon black, etc., and carbon black may preferably be used. The carbon black to be used in the present inventon may include, for example, channel black, furnace black (combustion black and thermal black), acetylene black, lamp black, oil fume, pine fume, tar black, Cowper black, or any other carbon black. The carbon black should preferably have a particle size of 0.01 to 300 mμ, and a mixture of carbon blacks with different particle sizes may also be used, if desired.

The basic dyes preferably used as the coloring agent of the present invention may include, for example, triphenyl methane dyes such as Crystal Violet (C.I. 42555), Malachite Green (C.I. 42000), Methyl Violet (C.I. 42535), Victoria Blue (C.I. 44045), Magenta (C.I. 42510) and the like; diphenylmethane dyes such as Auramine (A.I. 655) and the like; methyne and azamethyne dyes such as Astraphroxine FF (C.I. 48070), Aizen Cathilon Yellow 3GLH (produced by Hodogaya Kagaku Kogyo K.K., C.I. 48055), Aizen Cathilon Red 6BH (C.I. 48020), Astrazone Golden Yellow (produced by Bayer AG, C.I. 48054) and the like; xanthene dyes such as Rhodamine B (C.I. 45170), Rhodamine 6G (C.I. 45160) and the like; thiazoleazo and triazole azo dyes such as Astrazone Blue GL (C.I. 11052), Astazone Red F3BL (C.I. 11055) and the like; quinoneimine dyes such as Aizen Cathilon Blue 5GH (C.I. 11085), Methylene Blue (C.I. 52015) and the like; insulation type azo dyes having onium groups at the structural ends such as Aizen Cathilon Red GTLH (C.I. 11085), Sevlon Yellow 3RL (produced by Du Pont de Nemours & Co., C.I. 11087), Astrazone Blue FGL (C.I. 61512) and the like.

The oil soluble metal complex dyes may be, for example, symmetric 1:2 type azo metal complex dyes, asymmetric 1:2 type azo metal complex dyes, 1:1 type azo metal complex dyes, azomethyne metal complex dyes, formazan metal complex dyes, metal phthalocyanine dyes and organic base salts of these dyes. Specific examples may include Aizen Spilon Yellow 3RH (produced by Hodogaya Kagaku K.K., C.I. Solvent Yellow 25), Zapon Fast Yellow R (produced by BASF AG, C.I. 18690), Aizen Spilon Orange 2RH (C.I. Solvent Orange 40), Zapon Fast Scarlet B (C.I. 12783), Aizen Spilon Red GEH (C.I. Solvent Red 84), Zapon Fast Red BE (C.I. 12715), Zapon Fast Violet BE (C.I. 12196), Cyanine Blue BB (produced by Sumitomo Kagaku K.K., C.I. 74160), Balifast Black β3804 (produced by Orient Kagaku K.K., C.I. 12195), Aizen Spilon Yellow 3RH Special (C.I. Solvent Yellow 25:1), Aizen Spilon Orange 2RH Special (C.I. Solvent Orange 40:1), Aizen Spilon Blue 2BNH (C.I. Solvent Blue 117), Zapon Fast Blue HFL (C.I. 74350), Aizen Spilon Black BH Special (C.I. Solvent Black 22:1), etc.

The acidic dyes may include, for example, C.I. Acid Yellow 19, C.I. Acid Red 37, A.I. Acid Blue 62, C.I. Acid Orange 10, C.I. Acid Blue 83, C.I. Acid Black 01 and the like.

The direct dyes may include C.I. Direct Yellow 44, C.I. Direct Yellow 142, C.I. Direct Yellow 12, C.I. Direct Blue 15, C.I. Direct Blue 25, C.I. Direct Blue 249, C.I. Direct Red 81, C.I. Direct Red 9, C.I. Direct Red 31, C.I. Direct Black 154, C.I. Direct Black 17 and the like.

The disperse dyes may include C.I. Dispose Yellow 5, C.I. Dispose Yellow 51, C.I. Dispose Yellow 64, C.I. Dispose Red 43, C.I. Dispose Red 54, C.I. Dispose Red 135, C.I. Dispose Blue 56, C.I. Dispose Blue 73, C.I. Dispose 91 and the like.

The ballasted dye to be used in the present invention is a dye having at least one ballast group at the dye nucleus of azo dye, azomethyne dye, anthraquinone dye, naphthoquinone dye, sterol dye, quinophthalo dye, phthalocyanine dye, etc.

The ballast group of the present invention is a group highly soluble in the heat fusible substance, namely a group having an alkyl group or an alkylene group having 6 or more carbon atoms such as alkyl group, cycloalkyl group, aralkyl group, alkoxy group, alkylsulfonylamino group, alkylsulfonyl group, hydroxylalkyl group, cyanoalkyl group, alkoxycarbonlyalkyl group, alkoxyalkyl group, alkylthio group, etc. Particularly, a ballast group having at least one alkyl group having 6 or more carbon atoms in the molecule is preferred. Structural examples of the ballasted dyes may include those disclosed in the Patent Application (A) filed by the present Applicant on the even date herewith.

The coloring agent layer of the present invention should preferably contain a resin therein. The resin to be used in the present invention should preferably be one having a softening point (as measured by the ring and ball method) of 40° to 200° C., and it may be either a hydrophilic polymer or a hydrophobic polymer. Hydrophilic polymers may be exemplified by natural products or derivatives thereof, including gelatin, gelatin derivatives, cellulose derivatives, proteins such as casein, polysaccharides such as starch, etc., synthetic water soluble polymers, including water soluble nylon, water soluble polyvinyl compounds such as polyvinyl alcohol, polyvinylpyrrolidone, acrylamide polymers, etc., and further vinyl type, polyurethane type polymer latices. Hydrophobic polymers may be exemplified by the synthetic polymers as disclosed in U.S. Pat. Nos. 3,142,586; 3,143,386; 3,062,674; 3,220,844; 3,287,289; and 3,411,911. Preferable polymers are polyvinylbutyral, polyvinylformal, polyethylene, polypropylene, polyamide, cellulose derivative such as ethyl cellulose, cellulose acetate, etc., polystyrene, polyvinyl acetate, polyvinyl chloride, polyvinylidene chloride, ethylene-vinyl acetate copolymer, vinyl chloride-vinyl acetate copolymer, vinyl chloride-vinyl acetate-maleic acid terpolymer, acrylic resins such as polymethyl methacrylate, polyisobutylene, rosin derivatives such as ester gum, petroleum resin, cumarone indene resin, cyclic rubber, chlorinated rubber, etc. In the present invention, one or a combination of two or more of these resins may be used.

The composition of the coloring agent layer is not particularly limited, but it contains preferably 0 to 50 parts (by weight, hereinafter the same) of a heat fusible substance other than the heat fusible substance of the present invention, 5 to 20 parts of a coloring agent, 1 to 30 parts of a resin and 10 parts or more (more preferably 30 to 70 parts) of the heat fusible substance of the present invention per 100 parts of the total weight of the coloring agent layer.

With respect to film forming property of the coloring agent layer, the amount of the heat fusible substance of the present invention should preferably be 70 parts or less, and the effect of the present invention can be great at a level of 10 parts or more.

In the coloring agent layer of the present invention, various additives other than the above components may also be contained. For example, as the softening agent, there may preferably be used vegetable oils such as castor oil, linseed oil, olive oil, animal oils such as whale oil and mineral oils.

The support as the substrate to be used in the thermal recording medium of the present invention should desirably have a heat resistant strength and high dimensional stability and surface smoothness. As the heat resistant strength, the strength and dimensional stability capable of holding toughness as the substrate which will not be softened or plasticized at the heating temperature of the heating source such as a thermal head are required, and, as the surface smoothness, a smoothness enough for the heat fusible substance containing layer on the support to exhibit good transfer percentage is desired. The smoothness should desirably be 100 sec. or more as measured by the smoothness test by Bekk testing machine (JIS P 8119), more preferably 300 sec. or more to give an image with better transfer percentage and reproducibility. Examples of the material for support to be used preferably may be any of papers such as plain paper, capacitor paper, laminated paper, coated paper, etc; resin films such as polyethyleneterephthalate, polystyrene, polypropylene, polyimide, etc. and paper-resin film composites, metal sheets such as aluminum foil, etc. The thickness of the support may be generally about 60 μm or less in order to obtain good thermal conductivity, particularly preferably 2 to 20 μm. In the thermal recording medium of the present invention, the construction on the backside of the substrate may be designed as desired. It may also have a layer constitution other than the coloring agent material such as a subbing layer, an intermediate layer or a protective layer.

In the thermal recording medium of the present invention, the techniques suitable for coating a substrate such as a polymer film with the coloring agent layer is well known in the art and these techniques can also be used in the present invention. For example, the coloring agent layer may be a layer formed by hot melt coating of a coating solution comprising its composition. As the method for coating of the coloring agent layer of the present invention, there may be employed any of the known techniques such as the reverse roll coater method, the extrusion coater method, the gravure coater method or the wire bar coating method, etc. The coloring agent layer of the present invention may be made to have a thickness of 15 μm or less, preferably 1 to 8 μm.

According to the present invention, in the thermal recording medium containing a heat fusible substance on a support, wherein the heat fusible substance is contained in the coloring agent layer, the technical task as mentioned above can be overcome. Particularly, by use of the heat fusible substance of the present invention, the coated surface can become very homogeneous and smooth; and also improvement in heat transferability can be obtained to give a transferred image (printed letters) with good resolution without irregularity.

The present invention is now described by referring to the following Examples, by which the embodiments of the present invention are not limited at all. The "parts" as used hereinafter mean "parts by weight".

EXAMPLE 1

A polyethyleneterephthalate film support with a thickness of 6 μm was coated with a coloring agent layer coating solution (1) as shown below on its surface to obtain a thermal recording medium sample (1) having a coloring agent layer with a dry film thickness of 3.5 μm thereon.

| Coloring agent layer coating solution (1): | |
|---|---|
| Diacaruna 30 (produced by Mitsubishi Kasei K.K., M.W. ≈ 6000) | 55 parts |
| Paraffin wax (m.p. 68° C.) | 30 parts |
| Carbon black | 15 parts |

COMPARATIVE EXAMPLE 1

In Example 1, no Diacaruna 30 was used in the coloring agent layer coating solution (1) and the amount of paraffin wax was changed to 85 parts, following otherwise entirely the same procedure as in Example 1, to obtain a thermal recording medium sample (2) for comparative purpose.

EXAMPLE 2

In Example 1, the coloring agent layer coating solution (1) was replaced with a coloring agent layer coating solution (2) shown below, following otherwise entirely the same procedure as in Example 1, to obtain a thermal recording medium sample (3) of the present invention.

| Coloring agent layer coating solution (2): | |
|---|---|
| Diacaruna 30 (produced by Mitsubishi Kasei K.K., M.W. ≈ 6000) | 55 parts |
| Microcrystalline wax (m.p. 75° C.) | 45 parts |
| Ethylene-vinyl acetate copolymer (NUC 3160, produced by Nippon Unicar Co.) | 5 parts |
| Carbon black | 15 parts |

COMPARATIVE EXAMPLE 2

A thermal recording medium sample (4) for comparative purpose was obtained in entirely the same manner as in Example 1 except that no Diacaruna 30 was used and the amount of the microcrystalline wax was changed to 80 parts in the coloring agent layer coating solution (2).

EXAMPLE 3

A thermal recording medium sample (5) of the present invention was obtained in entirely the same manner as in Example 1 except that a coloring agent layer coating solution (3) shown below was used in place of the coloring agent layer coating solution (1).

| Coloring agent layer coating solution (3): | |
|---|---|
| Diacaruna PA30L (produced by Mitsubishi Kasei K.K., M.W. ≈ 3000) | 40 parts |
| Microcrystalline wax (m.p. 75° C.) | 10 parts |
| Quint D-200 (aliphatic hydrocarbon resin, produced by Nippon Zeon K.K.) | 15 parts |
| Beeswax | 20 parts |
| Carbon black | 15 parts |

COMPARATIVE EXAMPLE 3

Example 3 was repeated except that no Diacaruna PA30L was added and the amount of beeswax was changed to 60 parts to obtain a thermal recording medium sample 6 for comparative purpose.

The thermal recording medium samples obtained in the above Examples and Comparative examples were used for printing of letters on plain paper by means of a thermal printer (a test model machine mounted with a thin film type line thermal head with a heat generating element density of 8 dot/mm) to obtain the results as shown in Table 1.

TABLE 1

| Thermal recording medium No. | Uniformity of coloring agent coating film presence of coating irregularity (*1) | Heat transfer (*2) | Resolution (*3) |
|---|---|---|---|
| (1) (Invention) | None | ◎ | ◎ |
| (2) (Comparison) | " | x | x |
| (3) (Invention) | None | ◎ | ◎ |
| (4) (Comparison) | " | x | x |
| (5) (Invention) | None | ◎ | ◎ |
| (6) (Comparison) | " | x | x |

(*1) coated film of coloring agent layer was observed with a magnifier;
(*2) according to the three ranks of the mark which means complete transfer and the mark x which means partial remaining of untransferred coloring agent layer;
(*3) a checkered pattern is printed on plain paper with a Bekk's smoothness degree of 200 sec. and observed with a magnifier; according to the three ranks, the mark indicating sharp edge and the mark x indicating occurrence of loss and unfocused image.

As apparently seen from Table 1, it can be appreciated that the samples of the present invention can give coated surface of coloring agent layer which is homogenous and smooth, and a dye transferred image without irregularity and with a high resolving power can be obtained on a recording sheet such as plain paper.

EXAMPLE 4

A polyethyleneterephthalate film support with a thickness of 6 μm was coated with a coloring agent layer coating solution (4) as shown below on its surface to obtain a thermal recording medium sample (4) having a coloring agent layer with a dry film thickness of 3.5 μm thereon.

| Coloring agent layer coating solution (4): | |
|---|---|
| Diacaruna 30 (produced by Mitsubishi Kasei K.K., M.W. ≈ 6000) | 20 parts |
| PW-500 (produced by BARECO Co.) | 20 parts |
| Paraffin wax (m.p. 68° C.) | 45 parts |
| Carbon black | 15 parts |

EXAMPLE 5

In Example 4, the coloring agent layer coating solution (4) was replaced with a coloring agent layer coating solution (5) shown below, following otherwise entirely the same procedure as in Example 4, to obtain a thermal recording medium sample (5) of the present invention.

| Coloring agent layer coating solution (5): | |
|---|---|
| Diacaruna 30L (produced by Mitsubishi Kasei (PA30L) K.K., M.W. ≈ 3000) | 20 parts |
| WEISSEN 0252C (produced by Nippon Seiro K.K.) | 20 parts |
| Paraffin wax (m.p. 68° C.) | 45 parts |
| Carbon black | 15 parts |

EXAMPLE 6

In Example 4, the coloring agent layer coating solution (4) was replaced with a coloring agent layer coating solution (6) shown below, following otherwise entirely the same procedure as in Example 4, to obtain a thermal recording medium sample (6) of the present invention.

| Coloring agent layer coating solution (6): | |
|---|---|
| Diacaruna 30 (produced by Mitsubishi Kasei K.K., M.W. ≈ 6000) | 5 parts |
| OX-WEISSEN 0252C β15 (produced by Nippon Seiro K.K.) | 25 parts |
| Paraffin wax (m.p. 68° C.) | 55 parts |
| Carbon black | 15 parts |

EXAMPLE 7

In Example 4, the coloring agent layer coating solution (4) was replaced with a coloring agent layer coating solution (7) shown below, following otherwise entirely the same procedure as in Example 4, to obtain a thermal recording medium sample (7) of the present invention.

| Coloring agent layer coating solution (7): | |
|---|---|
| Diacaruna 30L (produced by Mitsubishi Kasei (PA30L) K.K., M.W. ≈ 3000) | 35 parts |
| Sunwax 171-P (produced by Sanyo Kasei K.K., M.W. ≈ 1500) | 50 parts |
| Carbon black | 15 parts |

By use of the samples as prepared above, letter printing was effected on plain paper similarly as described above to obtain the results as shown in Table 2.

TABLE 2

| Thermal recording medium No. | Uniformity of coloring agent coated film presence of coating irregularity (*1) | Heat transfer (*2) | Resolution (*3) |
|---|---|---|---|
| (4) (Invention) | None | ◎ | ◎ |
| (5) (Invention) | None | ◎ | ◎ |
| (6) (Invention) | None | ◎ | ◎ |

TABLE 2-continued

| Thermal recording medium No. | Uniformity of coloring agent coated film presence of coating irregularity (*1) | Heat transfer (*2) | Resolution (*3) |
|---|---|---|---|
| (7) (Invention) | None | ◎ | ○ |

(*1) coated film of coloring agent layer was observed with a magnifier;
(*2) the mark indicating complete transfer;
(*3) a checkered pattern is printed on plain paper with a Bekk's smoothness degree of 200 sec. and observed with a magnifier; according to the ranks, the mark indicating sharp edge and the mark indicating goodness as a whole in spite of slight occurrence of collapse at the edge.

As apparently seen from Table 2, it can be appreciated that the samples of the present invention can give coated surface of coloring agent layer which is homogeneous and smooth, and a carbon black transferred image without irregularity and with a high resolving power can be obtained on a recording sheet such as plain paper.

We claim:

1. A thermal recording medium on a support, said thermal recording medium having a heat-transferable coloring agent layer, wherein said coloring agent layer contains a heat fusible copolymer which has monomer units of olefin compound $CHR{=}CH_2$ and maleic anhydride

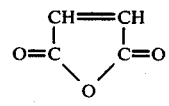

wherein R is an alkyl group having not more than 100 carbon atoms, and wherein said heat fusible copolymer has melting point of from 45° C. to 85° C.

2. The thermal recording medium of claim 1, wherein said coloring agent layer further contains polyethylenical heat fusible compound which has number average molecular weight in the range of from 200 to 10,000 and carbon black.

3. The thermal recording medium of claim 2, wherein said polyethylenical compound has the melting point in the range of from 40° C. to 140° C.

4. The thermal recording medium of claim 1, wherein the total number of said monomer units is in the range of from 2 to 30.

5. The thermal recording medium of claim 1, wherein said R is an alkyl group having carbon atoms not more than 50.

6. The thermal recording medium of claim 1, wherein said coloring agent layer contains a coloring agent selected from the group consisting of direct dyes, acid dyes, basic dyes, disperse dyes, oil-soluble dyes and carbon black.

7. The thermal recording medium of claim 9, wherein said coloring agent is carbon black.

8. The thermal recording medium of claim 1, wherein said coloring agent layer further contains a resin.

9. The thermal recording medium of claim 1, wherein said coloring agent layer contains said heat-fusible copolymer in an amount in the range of from 10% to 70% by weight based on the total amount of said coloring agent layer.

10. The thermal recording medium of claim 1, wherein said coloring agent layer has a thickness in the range of from 1 μm to 15 μm.

11. The thermal recording medium of claim 1, wherein said medium has a subbing layer, an intermediate layer or a protective layer.

12. The thermal recording medium of claim 1, wherein said support having a thickness in the range of from 2 μm to 60 μm.

13. The thermal recording medium of claim 1, wherein said R is an alkyl group having carbon atoms in the range of from 10 to 40.

14. The thermal recording medium of claim 1, wherein said heat fusible copolymer has a melt viscosity of not more than 1000 cp at 100° C.

* * * * *